US009266015B1

(12) United States Patent
Estrada et al.

(10) Patent No.: US 9,266,015 B1
(45) Date of Patent: Feb. 23, 2016

(54) MAGNETIC DOMINOS GAME

(71) Applicants: Isaac Estrada, Rio Rancho, NM (US); Zakkery D. Estrada, Rio Rancho, NM (US)

(72) Inventors: Isaac Estrada, Rio Rancho, NM (US); Zakkery D. Estrada, Rio Rancho, NM (US)

( * ) Notice: Subject to any disclaimer, the term of this patent is extended or adjusted under 35 U.S.C. 154(b) by 0 days.

(21) Appl. No.: 14/212,427

(22) Filed: Mar. 14, 2014

Related U.S. Application Data

(60) Provisional application No. 61/800,875, filed on Mar. 15, 2013.

(51) Int. Cl.
*A63F 3/00* (2006.01)
*A63F 9/20* (2006.01)

(52) U.S. Cl.
CPC ..... *A63F 9/20* (2013.01); *A63F 3/00694* (2013.01)

(58) Field of Classification Search
CPC ..... A63F 3/00
USPC ..... 273/239
See application file for complete search history.

(56) References Cited

U.S. PATENT DOCUMENTS

| | | | | | |
|---|---|---|---|---|---|
| 2,511,774 | A * | 6/1950 | Goldsmith | 273/239 |
| 2,570,625 | A * | 10/1951 | Zimmerman et al. | 446/92 |
| 2,665,913 | A * | 1/1954 | Hlavac | 273/239 |
| 2,946,592 | A * | 7/1960 | Post | 273/290 |
| 3,086,778 | A * | 4/1963 | Maurer | 273/108.55 |
| 3,556,529 | A * | 1/1971 | Noriega | 273/295 |
| 4,834,370 | A * | 5/1989 | Noble et al. | 473/566 |
| 4,834,870 | A * | 5/1989 | Osterberg et al. | 209/38 |
| 5,478,085 | A * | 12/1995 | Canner et al. | 273/239 |
| 6,517,070 | B1 * | 2/2003 | Clapera | 273/148 A |
| 7,154,363 | B2 * | 12/2006 | Hunts | 335/306 |
| 7,668,419 | B2 * | 2/2010 | Taverner et al. | 385/30 |
| 8,118,306 | B2 * | 2/2012 | Kean | 273/239 |
| 8,568,186 | B1 * | 10/2013 | Sung et al. | 446/2 |
| 2009/0243214 | A1 * | 10/2009 | Kean | 273/239 |

* cited by examiner

*Primary Examiner* — Michael Dennis
*Assistant Examiner* — Dolores Collins
(74) *Attorney, Agent, or Firm* — Isaac Estrada; Peacock Myers, P.C.

(57) ABSTRACT

A magnetic dominos game set with pieces that magnetically connect end to end, side to side and side to end, and methods for manufacturing and playing magnetic dominos.

6 Claims, 6 Drawing Sheets

MAGNETIC DOMINOS GAME

CROSS-REFERENCE TO RELATED APPLICATIONS

This application claims priority to and the benefit of the filing of U.S. Provisional Patent Application Ser. No. 61/800,875, entitled "MAGNETIC DOMINOS GAME", filed on Mar. 15, 2013, and the specification and claims thereof are incorporated herein by reference.

BACKGROUND OF THE INVENTION

1. Field of the Invention (Technical Field)

Embodiments of the present invention relate to magnetic dominos game sets. More particularly, they relate to a magnetic dominos game set with pieces that magnetically connect end to end, side to side and side to end, and methods for manufacturing and playing magnetic dominos.

2. Description of Related Art

In the game of dominos, players match the numbers of pieces and form lines of play of diverse shapes as the game progresses. Normally there is nothing connecting the pieces together, so care must be taken not to disrupt the line of play when playing new pieces. Magnetic dominos available in the market today offer the advantage that they maintain a more stable line of play. These dominos have a magnet at the back face of each piece, which is magnetically attracted to a ferrous metallic surface. The line of play is maintained stable because the pieces attach to the play surface. The pieces in these magnetic dominos sets cannot connect to each other on their sides and ends. Thus the only way for these domino pieces to be magnetically fixed is for the user to play the game on a ferrous metallic surface. When these types of magnetic domino pieces are not on a ferrous metallic surface, they do not maintain a stable, fixed line of play. Thus, there is a present need for magnetic dominos pieces capable of connecting, not only to a ferrous metallic surface, but also to the sides and ends of other dominos pieces in the set.

The present invention solves this problem by providing magnetic domino pieces capable of magnetically connecting on all sides of the piece, i.e., side to side, end to end, and side to end in addition to being capable of magnetically connecting to a ferrous metallic surface.

BRIEF SUMMARY OF THE INVENTION

Embodiments of the present invention comprise a magnetic dominos game set comprising a plurality of domino pieces each comprising two ends, two sides, a bottom, and a top; each of said domino pieces further comprising hollow spaces therein; each of said hollow spaces comprising one magnet; said hollow spaces being sufficiently larger than said magnets to allow said magnets to move inside said hollow spaces when attracted to a magnet of a different domino piece in said set, or a ferrous metal so that said pieces can connect to each other end to end, side to side, side to end, and to ferrous metallic surfaces; and plugs closing said hollow spaces.

One embodiment comprises a magnetic dominos game set wherein the pieces are made of a material selected from the group consisting of plastic, wood, bone, cardboard, abalone, aluminum alloy, glass, and onyx.

In one embodiment the magnets are neodymium magnets. In one embodiment the magnets are rectangular. In one embodiment the magnets are spherical. In one embodiment each of the domino pieces comprises four total hollow spaces. In one embodiment two of the hollow spaces are centrally disposed on the ends.

In one embodiment, two of the hollow spaces have a length shorter than a total length of the pieces and create a centrally disposed runway along the sides with a diameter larger than a diameter of the magnet.

In one embodiment, the hollow spaces' length is about three quarters of a total length of the pieces. In one embodiment, the runway has a final length of about one half a total length of the pieces.

In one embodiment, two of the plugs have a length shorter than a total length of the pieces and are placed into the hollow spaces to form the runways.

In one embodiment the plug length is about one quarter the total length of the pieces. In one embodiment, two of the hollow spaces are counterbore and are centrally disposed on the ends.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
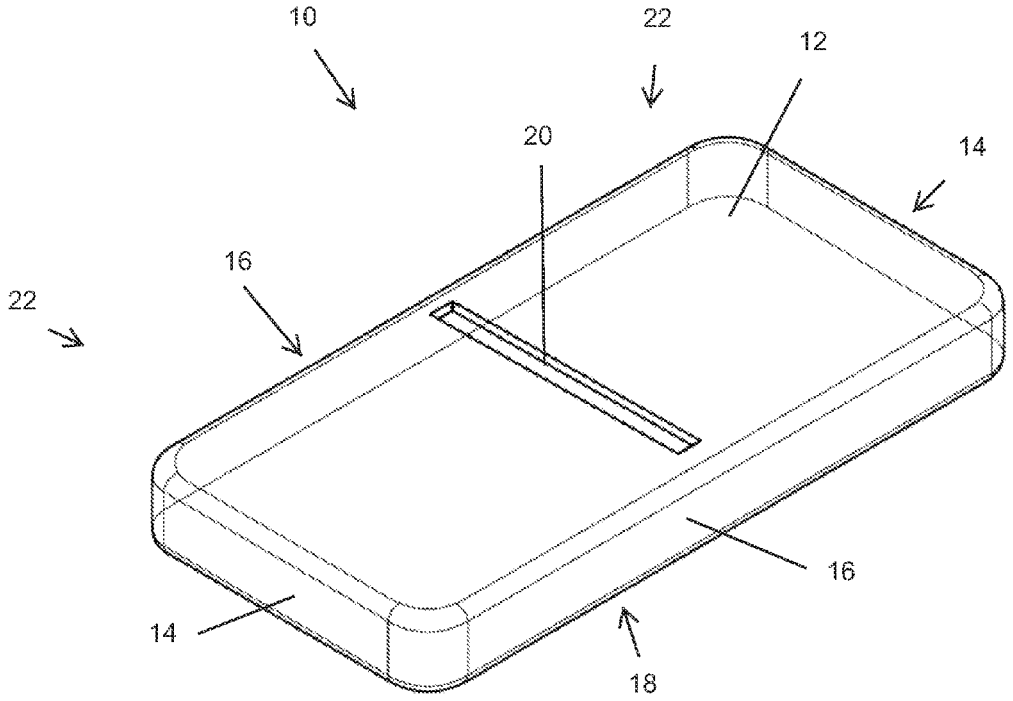
FIG. 1 is a perspective side view of a typical dominos piece.

Referring to the accompanying drawings, and particularly to FIG. 1, there is shown a typical domino piece 10 that is about twice as long as it is wide, comprising top face 12, ends 14, sides 16, and bottom face 18. Top face 12 of domino pieces is normally divided with a ridge, for example, ridge 20, which divides piece 10 into halves 22 of more or less square shape. Each half 22 of piece 10 has a value that is shown through dots or pips.

Although there are variations in modern domino sets, the values of each side typically range from zero to six. Different pieces with the same value on one or both of their halves 22 are said to be of the same suit. Pieces with the same values on both halves 22 are said to be doubles. When a player has a turn, the player adds a matching piece to the line of play.

The rules for the line of play often differ from one variant of the game to another. Sometimes doubles are played sideways and sometimes they serve as spinners, i.e., they can be played on all four sides, causing the line of play to branch out. Sometimes, the first piece is required to be a double, and serves as the only spinner. In some games such as Chicken Foot, all sides of a spinner must be occupied before anybody is allowed to play elsewhere. In Mexican Train and other Dominos Trains games, the game starts with a spinner from which various trains branch off. Most trains are owned by a player, and in most situations players are only allowed to extend their own train.

In one embodiment of the invention, magnetic domino pieces allow players to play the conventional dominos game with the added feature that the pieces connect magnetically to each other on their sides 16 and ends 14, and not simply to a ferrous metallic surface.

Figure 2:
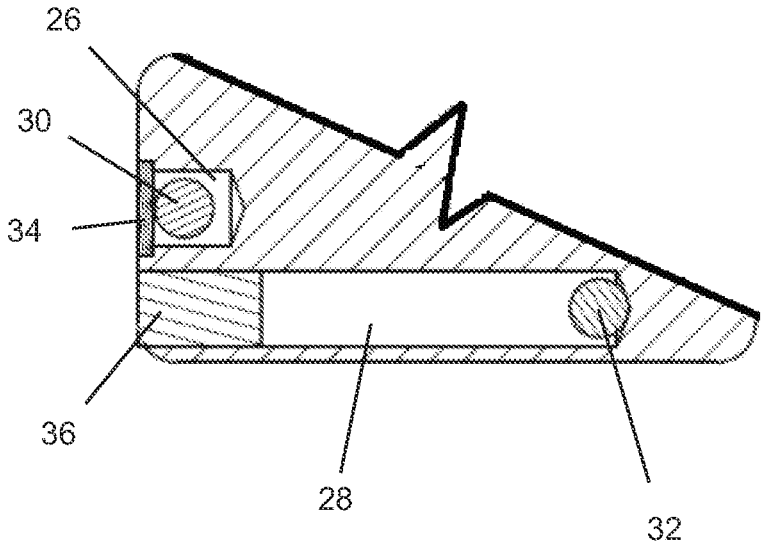
FIG. 2 is a cross sectional view of an embodiment of the present invention.

Referring now to FIG. 2, the cross section of an embodiment of the present invention illustrates one of many internal arrangements of magnetic dominos pieces according to embodiments of the present invention. Dominos piece 24 preferably comprises two shallow cavities 26, and two deep cavities 28, which are preferably hollow and comprise magnets 30, and 32, respectively. The opposite side of this piece (not shown) would preferably be manufactured in the same manner and look like a mirror image of the portion illustrated in FIG. 2.

Preferably, counterbore perforations or casting of cavities 26 allows plug 34, which is preferably larger in diameter (to fit the counterbore) than the deeper diameter of cavities 26, to be flush with the surface of ends 14. Long plugs 36 preferably fit into cavities 28.

Figure 3:
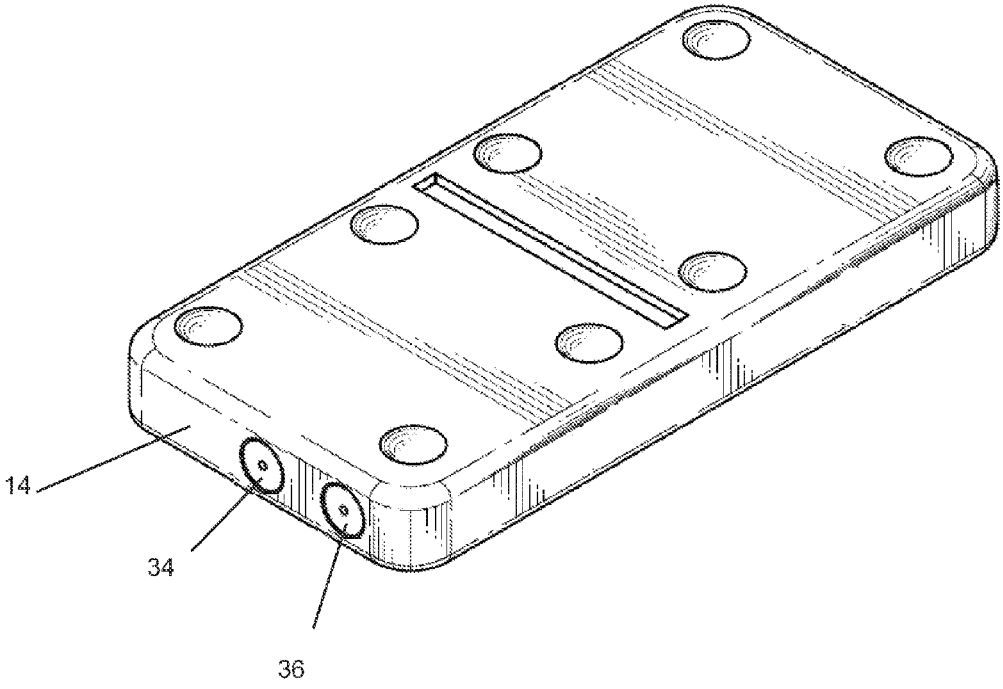
FIG. 3 is a perspective top view of the dominos piece of FIG. 2 illustrating perforation sites.

Preferably, cavities 28 are approximately ¾ of the total length of the piece in depth, and preferably, long plugs 36 are about one ¼ of the total length of the piece in length so that when put in place, the resulting cavity encasing magnets 32 functions as a runway (about ½ the total size of the piece with ¼ of solid material at each end) for the magnets, and allows them to move and spin around to align their opposite polarities when the magnets of a different dominos piece come near, allowing the pieces to magnetically connect. Similarly, magnets 30 in cavities 26 can move and spin to align their opposite polarities with the polarity of an approaching magnet to magnetically connect the pieces. FIG. 3 illustrates a perspective top view of the dominos piece in FIG. 2 showing plug 34 and long plug 36. This embodiment offers the advantage that all the pieces preferably have only four magnets each, which makes them easier and more affordable to manufacture, and more uniform. All pieces in a set being uniform as to the number and location of their magnets helps prevent cheating when they are being played because the players would not be able to tell doubles apart from the rest of the pieces.

In a different embodiment, a plurality of cavities 28 are distributed along the perimeter of the piece on the points that would preferably make contact with the ends or sides of other pieces while playing. For example, six cavities can preferably be placed in a regular piece such as the one illustrated in FIG. 4 (only three are shown and the other three are in similar places on the opposite, not visible, side of the piece). Optionally, doubles comprise one or more cavities 28 on their sides with at least one cavity 28 being placed approximately in the middle of their side.

In a different embodiment of the invention, pieces are molded to comprise cavities 28 with movable magnets in them. For example, magnets that have previously been encapsulated with enough room to spin inside can preferably be embedded in the piece during manufacturing.

Figure 4:
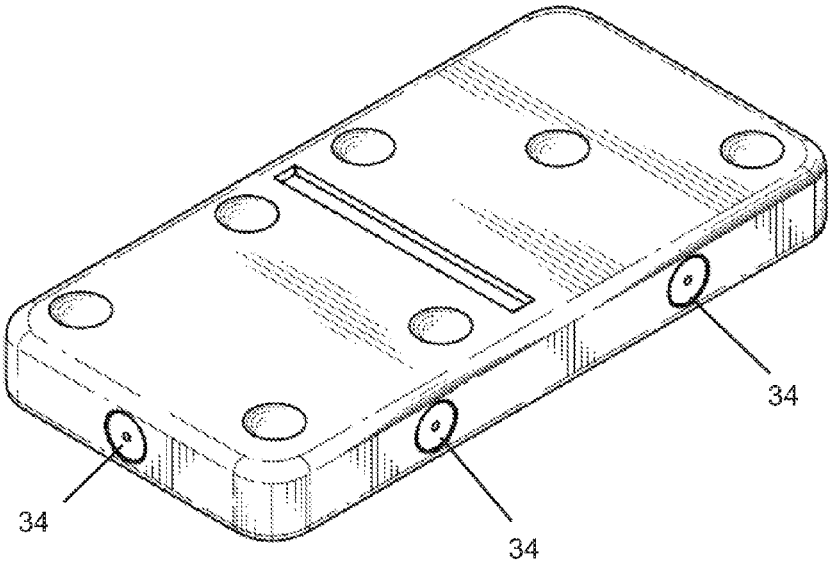
FIG. 4 is a perspective top view of a different embodiment of the present invention illustrating perforation sites on its ends and sides.
Figure 5:
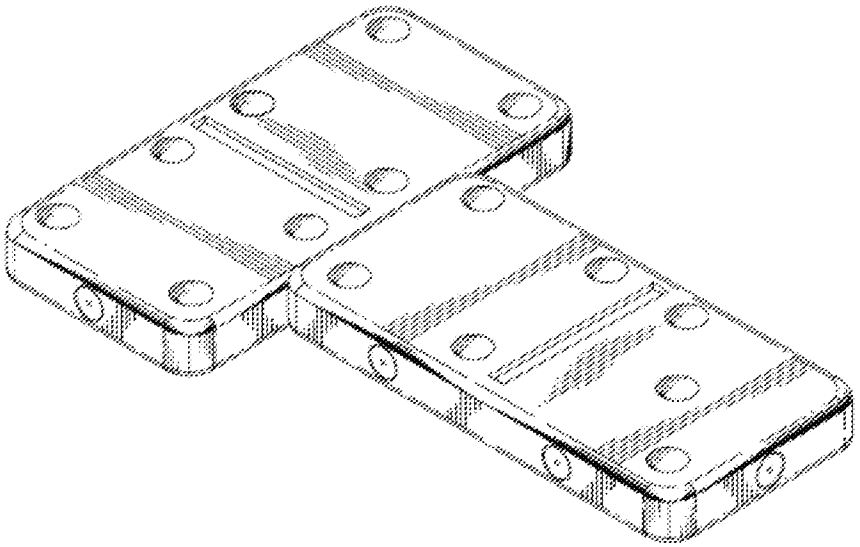
FIG. 5 illustrates two magnetic dominos pieces being played.
Figure 6:
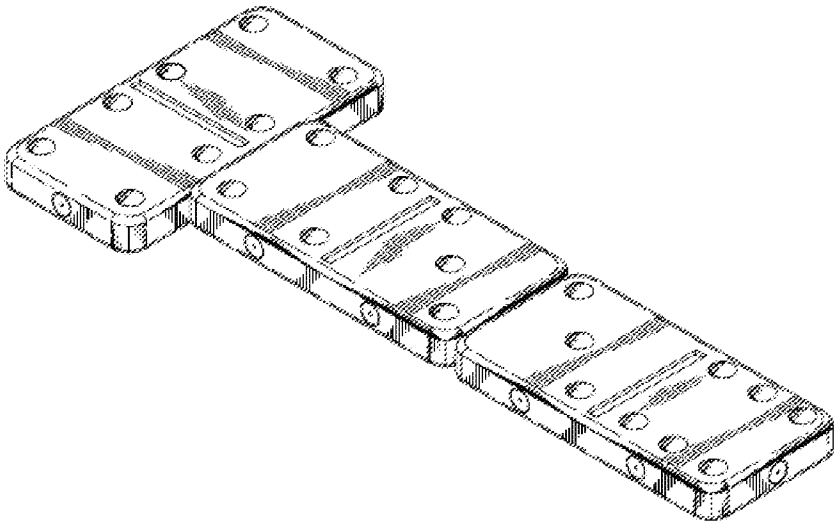
FIG. 6 illustrates three magnetic dominos pieces being played.

FIGS. 4-6 illustrate how the regular game of dominos can be played with magnetic dominos pieces according to embodiments of the present invention.

INDUSTRIAL APPLICABILITY

The invention is further illustrated by the following non-limiting examples.

Example 1

A magnetic dominos game was manufactured out of aluminum, a non-ferrous metal. The cavities were drilled in the aluminum piece according to FIG. 2 of this application. Neodymium spherical magnets were placed in the cavities (magnets were smaller than cavities to have room to move) before plugging the cavities. A total of four cavities were drilled for each piece, two straight and two counterbore, each contained a spherical magnet, and four plugs per piece were used (two short for counterbore cavities in the ends of the pieces, and two long for the other two cavities). Pips were placed on the pieces in accordance with a typical 28 piece set. The resulting game set had dominos pieces that connected end to end, side to end, and side to side in addition to connecting to metallic surfaces.

The preceding examples can be repeated with similar success by substituting the generically or specifically described components and/or operating parameters of this invention for those used in the preceding examples.

Note that in the specification and claims, "about" or "approximately" means within twenty percent (20%) of the numerical amount cited. Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A magnetic dominos game set comprising:

a plurality of domino pieces each comprising two ends, two sides, a bottom, and a top;

each of said domino pieces further comprising a first and a second cavity disposed within each end of said domino pieces;

each of said first and second cavities comprising one magnet;

said first and second cavities being sufficiently larger than said magnets to allow said magnets to move inside when attracted to a magnet of a different domino piece in said set, or a ferrous metal to form end magnetic connectors disposed at the centers of said ends;

a plug for each first and second cavities;

each of said domino pieces further comprising a third and a fourth cavity disposed on said sides;

each of said third and fourth cavities comprising one magnet inside and comprising elongated shapes with a length shorter than a total length of said pieces and forming a centrally disposed runway along said sides for the magnets in said third and fourth cavities to move along said sides;

said centrally disposed runway comprising a final length of about one half a total length of said pieces;

said third and fourth cavities being sufficiently larger than said magnets to allow said magnets to move inside when attracted to a magnet of a different domino piece in said set, or a ferrous metal, and to form adjustable side magnetic connectors disposed along said sides and forming adjustable magnetic connections anywhere along the length of said centrally disposed runway;

a plug for each third and fourth cavities comprising about one quarter of the total length of said pieces; and said domino pieces being magnetically connectable to each other end to end, side to side, side to end, and to ferrous metallic surfaces.

2. The magnetic dominos game set of claim 1 wherein said pieces are made of a material selected from the group consisting of plastic, wood, bone, cardboard, abalone, aluminum alloy, glass, and onyx.

3. The magnetic dominos game set of claim 1 wherein said magnets are neodymium magnet.

4. The magnetic dominos game set of claim 1 wherein said magnets are rectangular.

5. The magnetic dominos game set of claim 1 wherein said magnets are spherical.

6. The magnetic dominos game set of claim 1 wherein said first and second cavities are counterbored.

* * * * *